US006000369A

United States Patent [19]

Koizumi

[11] Patent Number: 6,000,369

[45] Date of Patent: Dec. 14, 1999

[54] STARTING SYSTEM FOR DIAPHRAGM CARBURETOR

[75] Inventor: Kimio Koizumi, Iwate-ken, Japan

[73] Assignee: U.S.A. Zama, Inc., Franklin, Tenn.

[21] Appl. No.: 08/944,068

[22] Filed: Oct. 2, 1997

[30] Foreign Application Priority Data

Oct. 3, 1996 [JP] Japan ..... 8-281702

[51] Int. Cl.[6] ..... F02M 1/04

[52] U.S. Cl. ..... 123/179.16; 261/63

[58] Field of Search ..... 123/179.16; 261/35, 261/63, DIG. 68, 56

[56] References Cited

U.S. PATENT DOCUMENTS

| | | | |
|---|---|---|---|
| 2,896,599 | 7/1959 | Ensign | 123/179.16 |
| 3,835,831 | 9/1974 | Ross | 123/179.16 |
| 4,085,720 | 4/1978 | Etoh | 123/127 |
| 4,271,093 | 6/1981 | Kobayashi | 261/34 R |
| 4,276,238 | 6/1981 | Yoshikawa et al. | 261/39 D |
| 4,646,691 | 3/1987 | Kiyota et al. | 123/179.16 |
| 4,862,848 | 9/1989 | Kobayashi et al. | 123/187.5 R |
| 4,936,267 | 6/1990 | Gerhardy et al. | 123/179.16 |

FOREIGN PATENT DOCUMENTS

| | | |
|---|---|---|
| 47/038218 | 4/1972 | Japan . |
| 55/069748 | 5/1980 | Japan . |
| 56-159540 | 8/1981 | Japan . |
| 57-459947 | 2/1982 | Japan . |
| 57-108444 | 6/1982 | Japan . |

*Primary Examiner*—Tony M. Atgenbright
*Assistant Examiner*—Arnold Castro
*Attorney, Agent, or Firm*—Lyon & Lyon LLP

[57] ABSTRACT

The object of the present invention is to easily provide an appropriate amount of starting fuel for all-purpose engines, without requiring any special skill. The upstream side and downstream side of a throttle valve in an air intake passage are connected by a bypass. This bypass and a constant-fuel chamber are connected by an increased-fuel passage which is equipped with a check valve. The system is arranged so that the bypass and increased-fuel passage are opened and closed more or less simultaneously by an opening-and-closing valve. The necessary amount of starting fuel can be supplied to the engine in a short time by means of the increased-fuel passage, so that starting can be accomplished by cranking the engine a few times. The flow of air into the constant-fuel chamber from the bypass is prevented by the check valve so that rough idling and the need to expel inflowing air are eliminated; and starting operations may be performed in any desired order.

18 Claims, 2 Drawing Sheets

STARTING SYSTEM FOR DIAPHRAGM CARBURETOR

FIELD OF THE INVENTION

The field of the present invention is diaphragm-type carburetors and associated devices used to supply fuel to all-purpose two-cycle engines, where the devices supply an extra amount of fuel to improve low-temperature starting characteristics.

BACKGROUND OF THE INVENTION

In most all-purpose two-cycle engines used as a power source in small vehicles and working machinery for agriculture and forestry, etc., fuel is supplied by means of a diaphragm type carburetor equipped with a constant-fuel chamber. The constant-fuel chamber is separated from the atmosphere by a diaphragm which adjusts fuel introduced from a fuel pump to a constant pressure, and feeds the fuel into the air intake passage.

In such diaphragm type carburetors, a means (generally a manual starting pump) for feeding out an extra amount of fuel into the air intake passage prior to the starting of the engine or for introducing a prescribed amount of fuel into the constant-fuel chamber, is provided in addition to the ordinary main fuel system and low-speed fuel system. The extra fuel thus provided improves the starting characteristics of the engine at low temperatures.

Carburetors equipped with such starting pumps typically include suction-type carburetors in which the action of the starting pump causes the fuel to flow from the fuel tank, through the fuel pump, into the constant-fuel chamber (or air intake passage), and finally to the starting pump. An example of a suction-type carburator is described in Japanese Patent Application Kokai No. Sho 55-69748), herein incorporated by reference. Push type carburetors operate by pushing the fuel from the fuel tank to the starting pump, into the fuel pump, and then to the constant-fuel chamber (or outside overflow). An example of such a system as seen in Japanese Patent Application Kokai No. Sho 47-38218, is incorporated herein by reference.

When the engine is cranked with starting fuel collected in the air intake passage or constant-fuel chamber as described above, the starting fuel flows toward the engine as a result of the negative pressure of the intake air. However, at low temperatures, the evaporization of the fuel is difficult and this flow becomes liquid flow. The liquid flow is propagated along the walls of the air intake passage or the walls of the intake manifold requiring a large quantity of starting fuel, especially at extremely low temperatures.

One conceivable method of dealing with this problem in a carburetor in which starting fuel is caused to flow out and collect in the air intake passage is to vary the number of times that the starting pump is operated depending on the engine temperature. However, a high degree of precision is required to cause an appropriate amount of starting fuel to flow out and collect in the air intake passage; accordingly, such a method is not generally practical. Also, another problem for systems in which starting fuel is accumulated and held in the constant-fuel chamber is the extremely small diameters of the idle port and main nozzle which cause the fuel to be sucked out into the air intake passage by the negative pressure of the intake air. As a result, the necessary amount of starting fuel cannot be supplied to the engine unless cranking is repeated numerous times.

The present invention solves the abovementioned problems encountered in conventional starting fuel supplying means in which cranking is performed after a starting pump is operated to improve cold starting performance by accumulation starting fuel in the air intake passage or constant-fuel chamber. In particular, the present invention solves the difficulty of maintaining an appropriate amount of starting fuel in the air intake passage, and prevents the need to perform cranking numerous times in order to suck the necessary amount of starting fuel out of the constant-fuel chamber. The present invention provides an easy-to-operate starting fuel supply device which makes it possible to supply the necessary amount of starting fuel held in the constant-fuel chamber to the engine in a short time so that low-temperature starting can be easily and reliably accomplished without the need for any particular skill.

SUMMARY OF THE INVENTION

Specifically, the present invention is constructed so that the upstream side and downstream side of a throttle valve installed in an air intake passage are connected by a bypass, fuel in a constant-fuel chamber is caused to flow out into the bypass by means of an increased-fuel passage, the aforementioned bypass and increased-fuel passage are caused to open and close more or less simultaneously by means of a manual opening-and-closing valve, and a check valve is installed in the increased-fuel passage to prevent the flow of air into the constant-fuel chamber from the bypass.

The starting fuel introduced into the constant-fuel chamber by the starting pump is sucked out and supplied to the engine by the negative pressure generated in the bypass when cranking is performed with the opening-and-closing valve open. Since the increased-fuel passage is a separate system from the main fuel system and low-speed fuel system, the effective diameter of the increased-fuel passage can be set as desired, making it possible to supply the required amount of starting fuel in a short time so that starting can be accomplished with little cranking.

As a result of the installation of the check valve one can avoid the problem of being unable to introduce starting fuel because of air being sucked into the constant-fuel chamber from the bypass when the opening-and-closing valve is opened before or during the operation of the starting pump. In suction type systems the inconvenient procedure requiring operation of the starting pump to expel air which is sucked in during cranking is also made unnecessary by use of the check valve, making it possible to achieve easy operation with no need for any special skill.

DETAILED DESCRIPTION OF THE PREFERRED EMBODIMENTS

Figure 1:
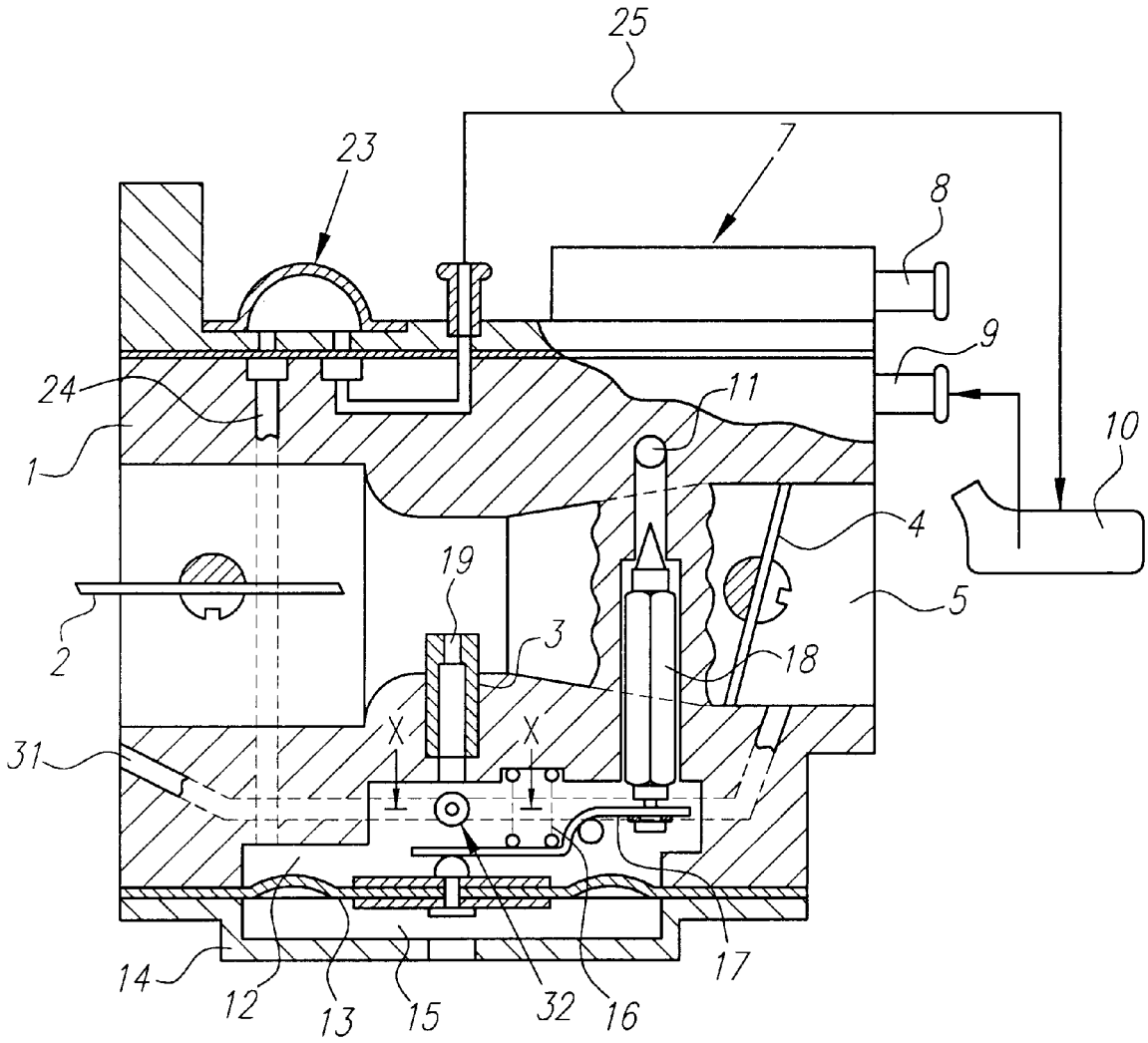
FIG. 1 is a longitudinal section which illustrates one working configuration of the present invention.

A working configuration of the present invention will be described with reference to the attached figures. In FIG. 1, a fuel pump 7 and a constant-fuel chamber 12 are installed on the outside of a carburetor main body 1 containing an air intake passage 5 in which a choke valve 2, venturi 3 and throttle valve 4 are installed in that order from the intake opening toward the outlet opening.

In its preferred embodiment, the fuel pump 7 is a well-known diaphragm type fuel pump. The diaphragm is caused to pulsate by the introduction of the pulse pressure generated in the crankcase of the engine via a pulse pressure introduction tube 8, so that fuel from the fuel tank 10 is sucked in and pressurized via a fuel introduction tube 9, and is then fed into the constant-fuel chamber 12 via a fuel passage 11.

The constant-fuel chamber 12 is separated by a diaphragm 13 from an atmosphere chamber 15 located inside a diaphragm cover 14. A fuel valve 18 is engaged with a lever 17 which is caused to contact the center of the diaphragm 13 by the force of a spring 16. The fuel valve 18 opens and closes the fuel passage 11 in accordance with the displacement of the diaphragm 13 so that a prescribed amount of fuel is held at a constant pressure. Then, the fuel in this constant-fuel chamber 12 is sucked out into the air intake passage 5 via a main nozzle 19 which opens into the narrowest part of the venturi 3 and idle and slow ports (not shown in the figures) which open to one side of the throttle valve 4.

A common finger-pressed dome type starting pump 23 is installed on the outside surface of the carburetor main body 1 alongside the fuel pump 7. A suction passage 24 extending from the constant-fuel chamber 12 connects to the intake opening of the starting pump 23, and a discharge passage 25 connects to a discharge opening of the starting pump 23 and leads to the fuel tank 10.

In cases where the engine is stopped with the constant-fuel chamber 12 empty of fuel, or in cases where the engine stops as a result of running out of fuel, the starting pump 23 is operated by hand prior to the next operation of the engine, so that fuel from the fuel tank 10 is supplied to the constant-fuel chamber 12 by suction via the fuel introduction tube 9, fuel pump 7 and fuel passage 11. When the engine is to be started at low temperatures, the starting pump 23 is further operated so that a prescribed amount of fuel, i.e., the amount of fuel required for starting, is introduced into the constant-fuel chamber 12.

After the constant-fuel chamber 12 is filled with fuel, fuel will flow through the suction passage 24, starting pump 23 and discharge passage 25. In a preferred embodiment, the accumulation of a sufficient amount of starting fuel can be appropriately confirmed by making at least the portions of the suction passage 24 and discharge passage 25 located in the vicinity of the starting pump 23 transparent.

A bypass 31 which extends parallel to the air intake passage 5 from the end surface on the intake side of the carburetor main body 1, and which opens into the air intake passage 5 at a point downstream from the throttle valve 4, is formed in the carburetor main body 1, so that air from an air cleaner (not shown in the figures) can be supplied to a point located downstream from the throttle valve 4 without passing through the choke valve 2, venturi 3 and throttle valve 4.

Figure 2:
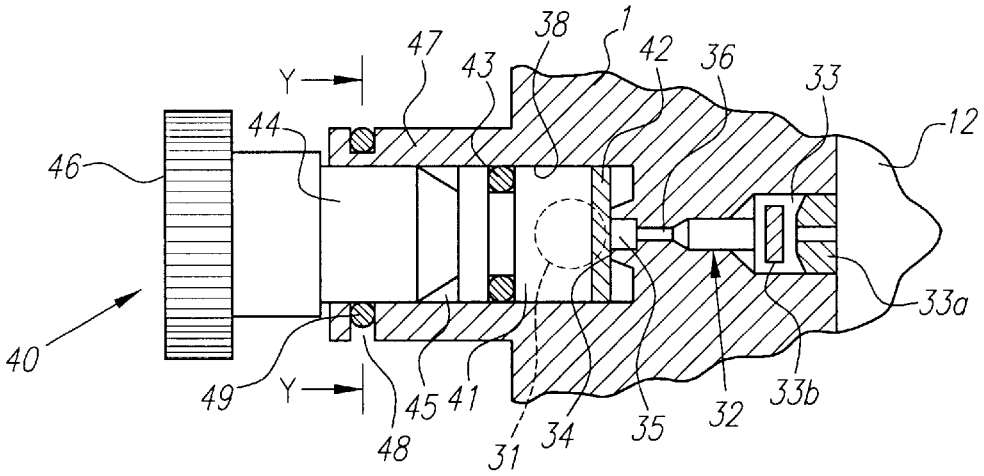
FIG. 2 is an enlarged sectional view along line X—X in FIG. 1, illustrating the closed state of the opening-and-closing valve.

As best seen in FIGS. 1 and FIG. 2, an increased-fuel passage 32 which connects the constant-fuel chamber 12 and the bypass 31 is also provided via preferred embodiment. This increased-fuel passage 32 is installed at right angles to the bypass 31, and comprises a check valve 33 which has a flat plate-form valve body 33*b* and a valve seat 33*a* installed in the intake end portion which opens into the constant-fuel chamber 12, (ii) a suction port 35 which opens at the center of a seating surface 34 formed in a location that is slightly withdrawn from the circumferential wall surface of the bypass 31, and (iii) a metering jet 36 which is formed between the abovementioned check valve 33 and suction port 35.

Additionally, a guide hole 38 is positioned on the same central axial line as the increased-fuel passage 32, the guide hole 38 having a diameter slightly larger than that of the bypass 31. The guide hole 38 is formed so that it cuts across the bypass 31 at right angles from the area surrounding the seating surface 34, and opens at the outside surface of the carburetor main body 1. A plunger-form valve body 41 is inserted into the guide hole 38. A plate-form sealing member 42 made of an elastic material which will adhere tightly to the seating surface 34 is fastened to the tip end surface of the valve body 41, and an O-ring 43 which closes the gap between the valve body 41 and the walls of the guide hole 38 is mounted on the outer circumferential surface of the valve body 41. A valve shaft 44 extends from the base end surface of the valve body 41, the valve shaft 44 having the same diameter as the valve body 41. At the tip end of said valve shaft 44 is an annular anchoring groove 45 which is formed at the base end surface of the valve body 41 and an inclined surface of the valve shaft 44. The anchoring groove 45 causes the diameter of the valve shaft 44 to decrease toward the tip end. The valve shaft 44 has a knob 46 located on the base end of said valve shaft 44, which protrudes to the outside of the carburetor main body 1.

An annular retaining groove 48 is formed in an eccentric manner in a tubular protrusion 47 which protrudes from the carburetor main body 1 so that the tubular protrusion 47 surrounds the guide hole 38. A portion of this retaining groove 48 opens into the guide hole 38. Furthermore, a stopper 49 consisting of a split-ring spring is mounted and held in the retaining groove 48 with one portion of the stopper 49 contacting the outer circumferential surface of the valve shaft 44.

Figure 3:
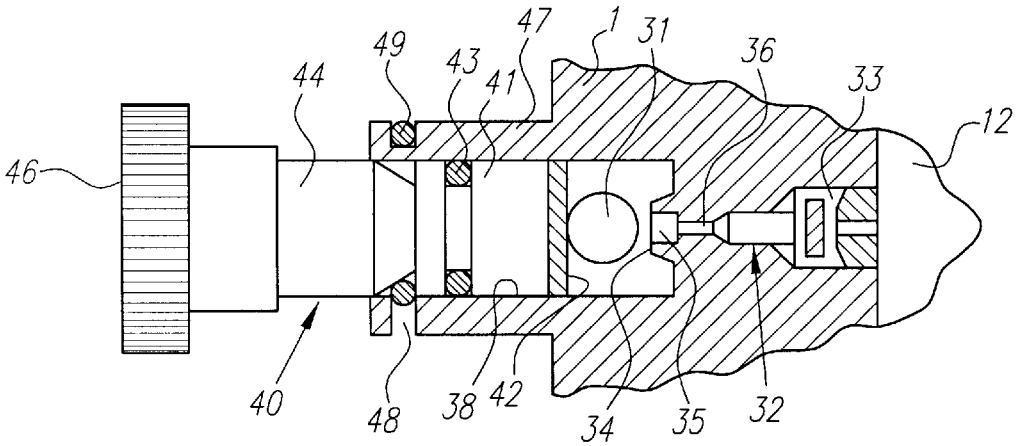
FIG. 3 is a sectional view similar to FIG. 2, illustrating the open state of the opening-and-closing valve.
Figure 4:
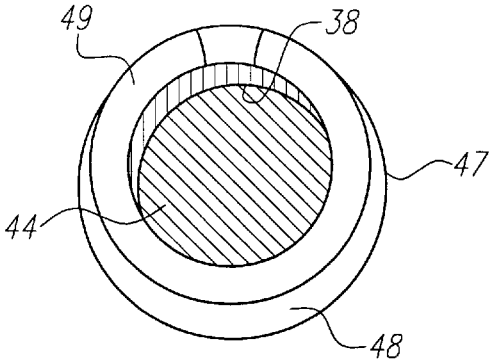
FIG. 4 is a sectional view along line Y—Y in FIG. 2.

The abovementioned seating surface 34, valve body 41, valve shaft 44 and knob 46 constitute a manual opening-and-closing valve 40. In the state shown in FIG. 2, in which the valve body 41 is pushed deeply into the guide hole 38 so that the sealing member 42 is caused to adhere tightly to the seating surface 34, the opening-and-closing valve 40 closes both the bypass 31 and the increased-fuel passage 32. When the valve body 41 is pulled by means of the knob 46, the bypass 31 and increased-fuel passage 32 are opened more or less simultaneously, and the bypass 31 is fully opened in the state shown in FIG. 3, in which the stopper is caused to enter the anchoring groove 45 by the elastic force of the stopper 49.

In cases where the engine is started at ordinary or high temperatures, starting can be accomplished by means of fuel from the existing fuel system, accordingly, the opening-and-closing valve 40 may remain closed. When the engine is to be started at low temperatures, the starting pump 23 is operated as described above so that a prescribed amount of fuel is introduced into the constant-fuel chamber 12; then, the opening-and-closing valve 40 is generally pulled to the fully open position shown in FIG. 3. With the constant-fuel chamber 12 in a full state, the engine can then be cranked. As a result of this cranking, air flows through the bypass 31 so that the fuel in the constant-fuel chamber 12 is sucked out into the bypass 31 from the suction port 35 (while being metered by the metering jet 36 with the check valve 33 open) by the negative pressure acting on the suction port 35, and this fuel is supplied to the engine.

Cranking causes air to flow through the air intake passage 5, so that fuel is sucked out from the main nozzle 19 when the idle port and choke valve 2 are closed. In this case, it is possible to cause a large amount of fuel to be sucked out into the bypass 31 by appropriately setting the effective diameter of the metering jet 36. Accordingly, even at extremely low temperatures, the necessary amount of starting fuel can be supplied to the engine in a short time, so that starting with complete combustion can be accomplished by cranking the engine a few times.

When starting the engine, persons inexperienced in the handling of engines may operate the starting pump 23 after opening the opening-and-closing valve 40 without following the abovementioned procedure, or may open the opening-and-closing valve 40 at an intermediate point during the operation of the starting pump 23. In such cases, the constant-fuel chamber 12 on the intake side of the starting pump 23 is placed under negative pressure, so that air begins to be sucked in from the bypass 31 via the increased-fuel passage 32. However, the check valve 33 is closed so that this suction of air is prevented. Thus, the difficulty in introducing starting fuel into the constant-fuel chamber 12 against the continued suction of air by the starting pump 23 tends to be prevented.

Accordingly, the operating procedure during starting may be performed as desired so that the device is extremely easy to operate for experienced and inexperienced persons alike.

When the engine has completely fired, the opening-and-closing valve 40 is returned to the closed position at an appropriate time, so that engine operation subsequently continues supplied with fuel from the main fuel system or low-speed fuel system that is sucked out into the air intake passage 5.

When the opening-and-closing valve 40 is returned to the closed position, the air sealed inside the increased-fuel passage 32 and the guide hole 38 attempts to enter the constant-fuel chamber 12; however, because the check valve 33 closes at the same time that the sealed-in air begins to be compressed, the flow of air into the constant-fuel chamber 12 will tend to be prevented. Accordingly, the problem of unstable idling or stopping of the engine due to the temporary feeding of fuel into the air intake passage 5 from the main fuel system or low-speed fuel system tends to be eliminated.

As a result of the above, a transition from idling based on a rich mixture during low-temperature starting with the opening-and-closing valve 40 in an open state to idling based on an ordinary mixture with the opening-and-closing valve 40 in a closed state can be accomplished without any stopping of the engine or great drop in engine revolution, so that starting of the engine at low temperatures can be accomplished in a stable and reliable manner.

Furthermore, in cases where the engine is stopped with the opening-and-closing valve 40 in an open state, the diaphragm 13 which forms the constant-fuel chamber 12 is caused to return from a fixed position, i.e., a position in which the diaphragm is displaced toward the constant-fuel chamber 12 by the suction negative pressure and suction of fuel, to the pre-starting position by the force of the spring 16. Also, the check valve 33 closes so that the suction of air into the constant-fuel chamber 12 from the bypass 31 tends to be prevented. Accordingly, there usually no need to expel sucked-in air by operating the starting pump 23 during restarting.

The present invention was described above with reference to the system illustrated in the figures, in which fuel is sucked into the constant-fuel chamber 12 by the starting pump 23, however, it would also of course be possible to apply the present invention to a system in which fuel is pushed into the constant-fuel chamber 12.

As was described above, the use of the present invention, in which a bypass 31 is installed in the air intake passage 5, and fuel from a constant-fuel chamber 12 is sucked out into the bypass 31 via an increased-fuel passage 32 equipped with a check valve 42 in synchronization with the opening and closing of the bypass 31 so that fuel for low-temperature starting can be obtained, allows arbitrary setting of the effective diameter of the increased-fuel passage 32. The increased-fuel passage is a separate system from the main fuel system and low-speed fuel system, so that the necessary amount of starting fuel can be supplied to the engine in a short time, making it possible to start the engine by cranking the engine only a few times.

Furthermore, since the flow of air into the constant-fuel chamber 12 from the bypass 31 is prevented by a check valve 42, the order in which the opening operation of the opening-and-closing valve 40 and the operation of the starting pump 23 are performed is unimportant. Accordingly, the following merits are also obtained: the device is convenient to use, there is usually no need to operate the starting pump 23 in order to expel air that may have flowed into the constant fuel chamber 12, and operation of the device is easy with no need for any special skill.

While the above description contains many specifics, these should not be construed as limitations on the scope of the invention, but rather as examples of particular embodiments thereof. Many other variations are possible. Accordingly, the scope of the present invention should be determined not by the embodiments described herein, but by the appended claims and their legal equivalents.

I claim:

1. A starting fuel supply device for a diaphragm type carburetor wherein said device comprises:

an air intake passage having a throttle valve located at a point downstream of an intake opening of the air intake passage;

an air bypass, wherein a downstream end of the air bypass is in fluid communication with the air intake passage at a point downstream of the throttle valve and an upstream end of the air bypass is in fluid communication with an air source located upstream of the throttle valve, the air bypass configured so that air may flow freely from the upstream end of the air bypass to the downstream end of the air bypass during carburetor operation;

an increased-fuel passage separate from the air bypass, wherein the increased-fuel passage connects the air bypass with a constant-fuel chamber;

a check valve installed in the increased-fuel passage which closes the increased-fuel passage when the pressure in the air bypass is higher than the pressure in the constant-fuel chamber; and an opening and closing valve configured to open and close the increased-fuel passage and the air bypass.

2. The device of claim 1 further comprising a metering jet located downstream of the increased-fuel passage.

3. The device of claim 1 wherein suction is used to provide fuel from a fuel source to the constant-fuel chamber.

4. The device of claim 1 wherein fuel is pushed from a fuel source to the constant-fuel chamber.

5. The device of claim 1 further including a starting pump having a suction passage fluidly connecting the starting pump to the constant fuel chamber and a discharge passage fluidly connecting the starting pump to a fuel supply.

6. The device of claim 5 wherein at least one portion of the suction passage is made from a transparent material.

7. The device of claim 5 wherein at least one portion of the discharge passage is made from a transparent material.

8. The device of claim 1 wherein the check valve opens and closes substantially simultaneously with the opening and closing of the opening and closing valve.

9. The starting fuel supply device of claim 2 wherein the device is installed on a two-cycle engine.

10. A method of starting an engine having a carburetor comprising an air intake passage having a throttle valve located at a point downstream of an intake opening of the air intake passage and a constant-fuel chamber, the method comprising the steps of:

a) opening an opening and closing valve, wherein the opening and closing valve is configured to open and close an increased-fuel passage and an air bypass passage substantially simultaneously;

b) cranking the engine;

c) providing air flow through the air bypass passage, wherein a downstream end of the air bypass is in fluid communication with the air intake passage at a point downstream of the throttle valve and an upstream end of the air bypass is in fluid communication with an air source located upstream of the throttle valve; and d) sucking fuel from the constant fuel chamber through the increased-fuel passage into the air bypass passage and out into the air intake at a point downstream of the throttle valve.

11. The method of claim 10 including the additional steps of closing a check valve when the pressure in the bypass exceeds the pressure in the constant fuel chamber and opening the check valve when the pressure in the constant fuel chamber exceeds the pressure in the bypass.

12. The method of claim 10 further including the additional step of metering the fuel from the constant fuel chamber into the bypass passage through a metering jet located at the downstream end of the increased fuel passage.

13. The method of claim 10 including the additional step of closing the opening and closing valve once the engine has fired.

14. A starting fuel supply device for a diaphragm type carburetor wherein said device comprises:

an air intake passage having a throttle valve located at a point downstream of an intake opening of the air intake passage;

an air bypass, wherein a downstream end of the air bypass is in fluid communication with the air intake passage at a point downstream of the throttle valve and an upstream end of the air bypass is in fluid communication with an air source located upstream of the throttle valve, the air bypass configured so that air may flow freely from the upstream end of the air bypass to the downstream end of the air bypass during carburetor operation; and an increased-fuel passage separate from the air bypass, wherein the increased-fuel passage connects the air bypass with a constant-fuel chamber.

15. The device of claim 14 including an opening and closing valve configured to open and close the increased-fuel passage and the air bypass.

16. The device of claim 14 including a check valve installed in the increased-fuel passage which closes the increased-fuel passage without substantially obstructing fluid flow through the air bypass when the pressure in the air bypass is higher than the pressure in the constant-fuel chamber.

17. The device of claim 16 including an opening and closing valve configured to open and close the increased-fuel passage and the air bypass.

18. A starting fuel supply device for a diaphragm type carburetor wherein said device comprises:

an air intake passage having a throttle valve located at a point downstream of an intake opening of the air intake passage;

an air bypass, wherein a downstream end of the air bypass is in fluid communication with the air intake passage at a point downstream of the throttle valve and an upstream end of the air bypass is in fluid communication with an air source located upstream of the throttle valve, the air bypass configured so that air may flow freely from the upstream end of the air bypass to the downstream end of the air bypass during carburetor operation; and an increased-fuel passage which fluidly connects the constant-fuel chamber with the air intake passage downstream of the throttle valve, the increased-fuel passage configured to allow fluid flow from the constant-fuel chamber to the air intake passage.

* * * * *

UNITED STATES PATENT AND TRADEMARK OFFICE

CERTIFICATE OF CORRECTION

PATENT NO. : 6,000,369
DATED : December 14, 1999
INVENTOR(S) : Kimio Koizumi

It is certified that error appears in the above-identified patent and that said Letters Patent is hereby corrected as shown below:

Title page, item [54],
Please change the title to -- STARTING FUEL SUPPLY DEVICE FOR DIAPHRAGM TYPE CARBURETOR --.

Column 1,
Lines 1 and 2, please change the title to -- STARTING FUEL SUPPLY DEVICE FOR DIAPHRAGM TYPE CARBURETOR --.

Column 1,
Line 35, please delete the ")" after Sho 55-69748.

Column 2,
Line 3, please insert "of" between "accumulation starting".

Column 6,
Line 3, please change "valve 42" to -- valve 33 --.
Line 14, please change "valve 42" to -- valve 33 --.

Signed and Sealed this

Second Day of October, 2001

*Attest:*

Nicholas P. Godici

NICHOLAS P. GODICI
*Acting Director of the United States Patent and Trademark Office*

*Attesting Officer*